United States Patent [19]

Dunn Thompson

[11] Patent Number: 5,012,160

[45] Date of Patent: Apr. 30, 1991

[54] ACCORDION MOUNT FOR SOLAR CELLS INCLUDING POINT-OF-PURCHASE DISPLAY WITH LEDS

[75] Inventor: Kathleen D. Dunn Thompson, Colorado Springs, Colo.

[73] Assignee: Colorado Instruments, Inc., Colorado Springs, Colo.

[21] Appl. No.: 337,419

[22] Filed: Apr. 13, 1989

[51] Int. Cl.[5] ..... H05B 37/02; H05B 41/36

[52] U.S. Cl. ..... 315/149; 315/152; 40/465; 362/183; 362/812

[58] Field of Search ..... 40/463, 465, 427, 617, 40/621, 559, 560; 362/183, 253, 255, 368, 371, 372, 800, 812, 157; 315/149, 150, 156, 157, 158, 152, 155

[56] References Cited

U.S. PATENT DOCUMENTS

| | | | |
|---|---|---|---|
| 4,379,324 | 4/1983 | Thompson | 362/253 |
| 4,384,317 | 5/1983 | Stackpole | 362/183 |
| 4,596,083 | 6/1986 | Thompson | 40/473 |

OTHER PUBLICATIONS

Hewlett-Packard Purchasing Data for low current LED lamps.

*Primary Examiner*—Eugene R. LaRoche
*Assistant Examiner*—Ali Neyzari
*Attorney, Agent, or Firm*—Nixon & Vanderhye

[57] ABSTRACT

A display assembly particularly for the point-of-purchase field utilizes a light source to power the display. A solar cell is electrically connected, through a simple flashing circuit, to an array of light emitting diodes (LEDs). The diodes have a current usage of about 2 ma or less; e.g., they may be double heterojunction AlGaAs/GaAs material. The circuit has a current drain of about 0.1 ma or less. The solar cell may be mounted between an artificial light source (such as a fluorescent bulb) and a surrounding metal housing by sheet material having an undulating (e.g., accordion) configuration. Transparent UV inhibited plastic film tape may attach the solar cell to a central undulation of the sheet material while magnets strips attach side edges of the sheet material to a metal housing, so that the solar cell is in close proximity to (e.g., touches) the light source.

16 Claims, 1 Drawing Sheet

ACCORDION MOUNT FOR SOLAR CELLS INCLUDING POINT-OF-PURCHASE DISPLAY WITH LEDS

BACKGROUND AND SUMMARY OF THE INVENTION

Effective point-of-purchase displays utilizing an artificial or natural light source for powering a motion display have been successfully marketed for a number of years. These units typically comprise a solar cell mounted on reflective material or the like that is clipped directly onto a light source, such as a fluorescent or incandescent bulb, and are connected to a motor which turns a sign, mirror, or like display. Exemplary forms of such devices are v illustrated in U.S. Pat. Nos. 4,379,324 and 4,596,083.

While the assemblies disclosed in U.S. Pat. Nos. 4,379,324 and 4,596,083 are very worthwhile, there are some circumstances where different mounting of the solar cells is required, or where it is desirable to power a display other than one associated with a motor. According to the present invention, an energy converting assembly is provided which is particularly useful for point-of-purchase displays, which allows such desired results to be accomplished.

According to one aspect of the present invention, an energy converting assembly is provided which is specifically designed to mount solar cells in close proximity with a light source, is connected to a housing for the light source. The assembly specifically includes a particular mounting and spacing means to which a solar cell is mounted, which is connected to the housing and occupies the space between the housing and the light source (e.g., fluorescent bulb) so that the solar cell is held in close proximity to (e.g., in contact with) the light source. Preferably the mounting structure comprises a piece of sheet material, such as cardboard having a thickness of about 0.01–0.015 inches, with an undulating configuration (e.g., accordion, pleated, or serpentine), which occupies the space between the housing and the light source. Magnet strips can be used to connect the mounting means to the housing where the housing is metal. The solar cell is electrically connected to a display, and it powers the display.

Also according to the present invention, a display is provided which is effective for getting the attention of a potential purchaser, yet does not utilize a motor, and can be powered solely by a solar cell. This is accomplished by providing an array of light emitting diodes, each having a maximum current requirement of about 2 ma. Also, circuitry is provided for flashing the diodes, which circuitry has a minimum current drain. Only by utilizing a low current drain circuit and low current requirement LEDs is it possible to effectively power point-of-purchase display with solar cells utilizing an artificial light source without adversely restricting the light supply from the light source. The LEDs are preferably double heterojunction AlGaAs/GaAs LEDs, and may be red, yellow, or green. As many as twenty or thirty LEDs may be provided in a single array.

It is a primary object of the present invention to provide versatile and effective energy converting assemblies, particularly for point-of-purchase display use, powered by a light source preexisting at the point-of-purchase. This and other objects of the invention will become clear from an inspection of the detailed description of the invention and from the appended claims.

DETAILED DESCRIPTION OF THE DRAWINGS

Figure 1:
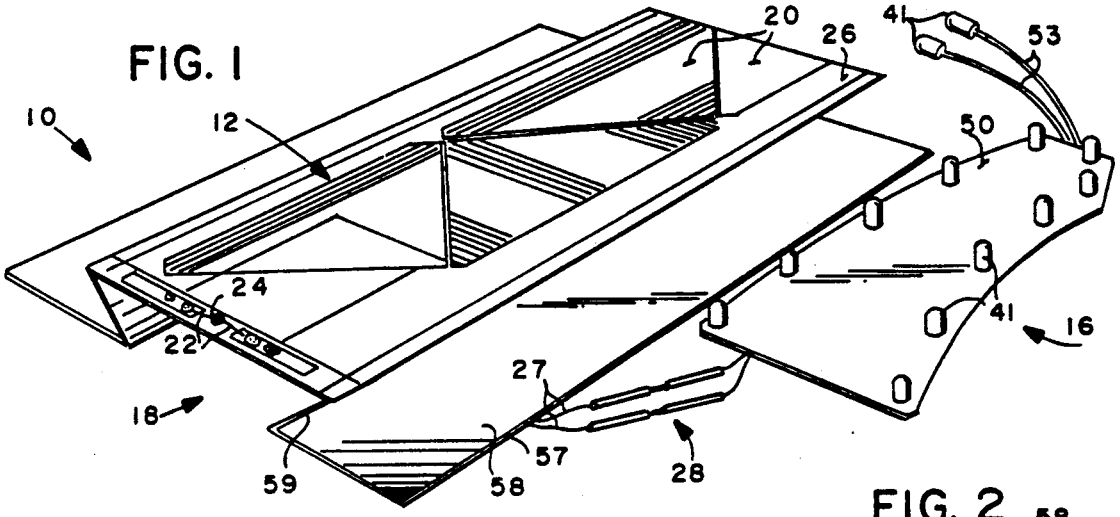
FIG. 1 is a a top perspective view of an exemplary light actuated point-of-purchase display assembly according to the invention.

An exemplary energy converting assembly according to the present invention, which is particularly useful for point-of-purchase displays, is illustrated generally by reference numeral 10 in FIG. 1. The assembly 10 includes a solar (photovoltaic) cell 12 (which may be a plurality of interconnected individual cell components), circuitry means 14, a display 16, and mounting and spacing means for mounting the solar cell 12 and for occupying the space between the solar cell and a housing for an artificial light source.

Preferably the solar cell 12 is mounted on a central face 20 of the mounting and spacing means 18. Wires 22 extending from the solar cell 12 pass through an opening 24 in the face 20, and to the circuitry means 14. The circuitry means 14 are glued, taped, or otherwise attached to the face (56) of the means 18 opposite the face 20. While the solar cell 12 can be held onto the face 20 by conventional adhesive applied to the back thereof, under some circumstances it is desirable to instead, or also, utilize a transparent plastic film 26 for holding it onto the face 20, and for protecting it from mechanical abrasions and the like. In the preferred form according to the invention, the transparent film 26 is 3M "Scotchcal" #639 tape made from UV inhibited transparent film.

In order to provide maximum flexibility of the assembly according to the invention, it is highly desirable to provide quick release connectors in the wires between the circuitry 14 and the display 16. A conventional quick release connector system is illustrated generally by reference numeral 28 in FIGS. 1 and 2, and include interconnectable male and female elements.

Figure 4:
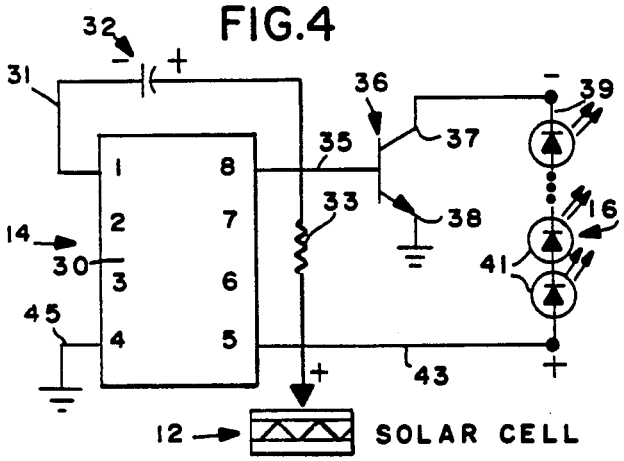
FIG. 4 is circuit diagram of an exemplary flashing circuit utilizable in the assembly of FIGS. 1–3.

The circuitry means 14, a preferred form of which is illustrated in FIG. 4, is designed to effect flashing of light emitting diodes associated with the display 16. The circuitry 14 is very simple and has a low current drain, typically less than about 0.1 ma (e.g., 0.07 ma). The circuitry 14 consists of the following elements: Integrated circuit 30, preferably LM3909N, connected by electrical connection 31 to a 100 microfarad (at 16 volts DC) electrolytic capacitor 32, which in turn is connected to a 10K ohm, one quarter WT resistor 33, and then ultimately to the solar cell 12. The electrical connection 31 extends from position 1 of the IC 30. Extending from position 8 of the IC 30 is an electrical connection 35 which is connected to the base of the transistor 36 (preferably a 3904), with the emitter 38 of the transistor 36 connected to ground, and the terminal 37 thereof connected by electrical connector 39 to an array of light emitting diodes 41 of the display 16. The light emitting diodes are in turn connected by electrical connection 43 to position 5 of the IC 30 and position 4 of the IC 30 is connected to ground by electrical connector 45.

The light emitting diodes 41 each have a maximum current requirement of about 2 ma. Preferably the light emitting diodes are double heterojunction AlGaAs/-GaAs material LEDs, such as are commercially available from Hewlett Packard, e.g., part numbers HLMP-D150, 4700, 4719, or 4740. A red LED has a current requirement of about 1 ma, while the yellow and green has a current requirement of about 2 ma. A typical array of solar cells 12, that is suitable for point-of-purchase use without restricting light from a light source in a lighted sign or the like, has a voltage of about 2.4 volts, and can produce current of about 20–33 ma, and therefore could power on the order of 20–30 LEDs 41 in a display 16.

Figure 2:
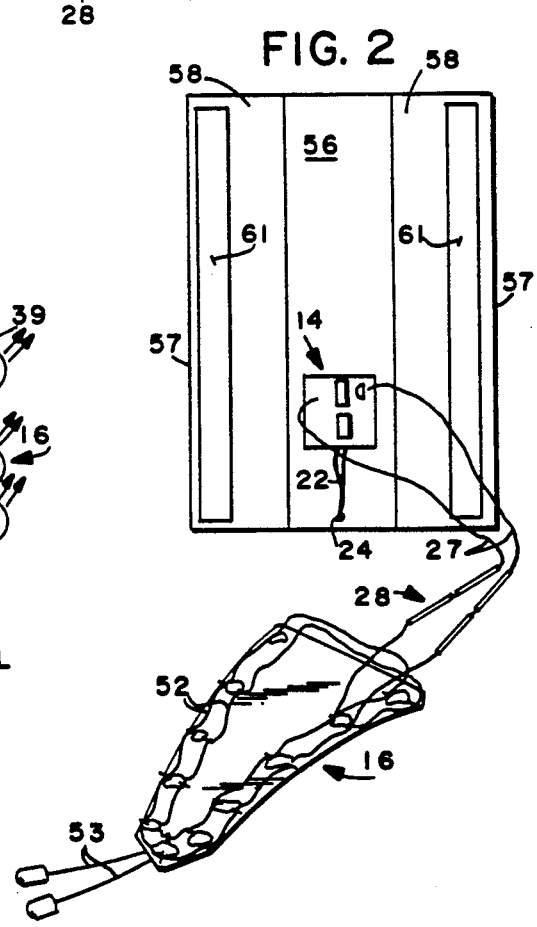
FIG. 2 is a bottom view of the assembly of FIG. 1.
Figure 3:
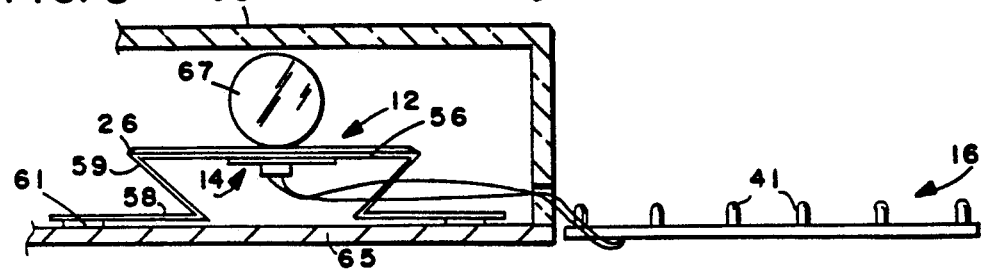
FIG. 3 is an end view, partly in cross section and partly in elevation, showing the assembly of FIGS. 1 and 2 in association with a florescent light bulb in a store display.

The display 16 illustrated in FIGS. 1 through 3 is shown only schematically, and without artwork or the like associated therewith. The display may include a display card 50 of cardboard or fiberboard, having a plurality of holes therein through which the LEDs 41 extend, the surface of the card 50 engaging the LEDs and holding them in place. On the opposite face of the card 50 from which the LEDs 41 extend wires 52 are provided interconnecting the LEDs. Also, the loose wires 53 may also be interconnected thereto, having LEDs 41 at the ends thereof, for disposition at a different part of the artwork than the majority of the LEDs 41.

The mounting and spacing means lB, for mounting the solar cell 12 and occupying the space between a light source and a housing for the light source, preferably comprises a piece of sheet material having a top face 20, bottom face 56, and opposite side edges 57. Between the side edges 57, the sheet material has an undulating configuration. The undulating configuration can be an accordion configuration such as illustrated in the exemplary embodiment shown in FIGS. 1 through 3, or it can be pleated, serpentine, sinusoidal, or other like configurations. In the particular embodiment illustrated in the drawings, the sheet material is cardboard having a thickness of about 0.01–0.015 inches (e.g., about 0.012 inches corresponding to about 120 pound paper weight). The cardboard is undulated so that in addition to the central panel or undulation (20, 56), there are side panels 58 adjacent the edges 57, and central angled panels 59 between the central panel and side panels, pivotally connected at the folds of the "accordion." Magnet strips 61 are glued, attached by double sided tape, or otherwise affixed to the panels 58 adjacent the edges 57 for attaching the means 18 to a metal housing or the like. If the housing is not metal, double sided tape could be substituted to the magnet strips 61. The strips 61 are commercially available, e.g., from Magnetics, Inc., under the trademark "ULTRAMAG."

The typical manner in which the means 18 mounts the solar cell 12 in association with an artificial light source is illustrated in FIG. 3. In FIG. 3, a metal housing 65 with a transparent glass or plastic cover 66 is provided for at least one fluorescent bulb 67 and the like. The cover 66 may have indicia—e.g., be a lighted sign. The magnets 61 are attached to the housing 65, and the edges 57 are moved toward and away from each other so as to adjust the spacing of the solar cell 12 from the panels 58. Because of the stiffness of the sheet material and the accordion configuration, the portions 59 will be disposed at different angles to the horizontal upon movement of the edges 57 with respect to each, and thereby will adjust the position of the solar cell 12 with respect to the panels 58 (there being a pivotal interconnection between the various panels 20, 56, 59, and 58). The panels 58 are moved until the solar cell 12 (actually the transparent tape 26 covering the solar cell) is touching the fluorescent bulb 67, or is otherwise in close proximity thereto. Whenever the light 67 is on, the solar cell flashes the LEDs 41 in the display 16, which may be remote from the sign housing 65.

Various other modifications are possible. For example, the means 18 could be dimensioned so that the bulb 67 would fit between the panels 59 thereof, and the solar cell 12 could be placed on the face 56 rather than the face 20 so that when the bulb 67 is within the volume defined by the panels 20/56 and 59 and is "on," light is received by cell 12.

While the invention has been described with respect to the particular mounting means 18 and the particular display 16 illustrated in the drawings, it is to be understood that a wide variety of other mounting means or displays could be utilized. For example, the display 16 (and circuitry 14) could be utilized with the particular solar cell mounting arrangements illustrated in U.S. Pat. No. 4,379,324, or the mounting means 18 and associated components could be used to power a DC motor or the like, such as disclosed in said U.S. Pat. 4,596,083 (the disclosures of both patents are incorporated by reference herein).

It will thus be seen that according to the present invention, a simple, effective, and versatile energy converting assembly and point-of-purchase display assembly, have been provided. While the invention has been herein shown and described in what is presently conceived to be the most practical and preferred embodiment thereof, it will be apparent to those of ordinary skill in the art that many modifications may be made thereof within the scope of the invention which scope is to be accorded the broadest interpretation of the appended claims so as to encompass all equivalent structures and devices.

What is claimed is:

1. An energy converting assembly for operative association with a light source mounted in a housing, comprising:

(a) a solar cell;

(b) mounting and spacing means for mounting said solar cell and for occupying space between a light source and a housing for the light source, and having a first portion and a second portion remote from aid first portion;

(c) means for holding said solar cell on said first portion of said mounting means;

(d) means disposed on said mounting means second portion for connecting said mounting means to the housing for the light source, so that the solar cell is positioned by the mounting means in close proximity with the light source, with the mounting and spacing means occupying space between the housing and the light source;

(e) a display electrically connected to said solar cell, and powered thereby when the solar cell receives light rom the light source; and wherein said mounting and spacing means comprises sheet material having first and second faces, and an undulating configuration between first and second opposite side edges thereof, said first portion comprising part of said first face at an undulation substantially centrally between said first and second side edges.

2. An assembly as recited in claim 1 wherein said display comprises an array of light emitting diodes, each having a maximum current requirement of about 2 ma.

3. An assembly as recited in claim 2 further comprising circuitry means electrically connected to said solar cell and said light emitting diodes and mounted on said mounting means between said first and second portions thereof for effecting flashing of said light emitting diodes.

4. An assembly as recited in claim 1 wherein said second portion of said mounting means comprises two spaced portions of said second face adjacent said first and second side edges, respectively, of said sheet material.

5. An assembly as recited in claim 4 wherein said undulating configuration is an accordion configuration.

6. An assembly as recited in claim 5 wherein said sheet material is cardboard having a thickness of about 0.01–0.015 inches.

7. An assembly as recited in claim 5 wherein said means (d) comprises magnet strips.

8. An assembly as recited in claim 5 wherein said means (c) comprises transparent UV inhibited plastic film.

9. An assembly as recited in claim 2 wherein the electrical connections between said display and said solar cell are quick disconnect connectors having cooperating male and female elements.

10. An assembly as recited in claim 3 wherein said circuitry means consists essentially of an integrated circuit, a capacitor, a resistor, and a transistor, all electrically interconnected to each other; and wherein said solar cell is mounted on a first face of said means (b), and said circuitry means is operatively mounted to a second face of said means (b), opposite said first face at a position directly adjacent said solar cell.

11. An assembly as recited in claim 3 wherein said mounting and spacing means comprises sheet material having first and second faces, and an undulating configuration between first and second opposite side edges thereof, said first portion comprising part of said first face at an undulation substantially centrally between said first and second side edges, and wherein said undulating configuration is an accordion configuration, and wherein said sheet material is cardboard having a thickness of about 0.01–0.015 inches.

12. A point-of-purchase display assembly, comprising:

a solar cell;

means for mounting said solar cell adjacent a light source;

an array of light emitting diodes, each having a maximum current draw of about 2 ma, in a point-of-purchase display;

circuit means for effecting flashing of said light emitting diodes having a current drain of less than about 0.1 ma, and consisting essentially of an integrated circuit, a capacitor, a resistor, and a transistor, all operatively electrically connected to each other; and electrical connector means for electrically connecting said circuitry means, array, and solar cell so that when said solar cell receives light from a light source, it flashes said light emitting diodes.

13. A display assembly as recited in claim 12 wherein said connector means comprise quick disconnect connectors having cooperating male and female elements.

14. A display assembly as recited in claim 12 wherein said array of light emitting diodes comprises between about 20 and 30 diodes.

15. An energy converting assembly in combination with an artificial light source mounting in a housing that is at least in part metal, said combination comprising:

a solar cell;

a piece of sheet material having opposite first and second faces, and opposite first and second side edges, with an undulating configuration between said side edges;

means for mounting said solar cell on said first face of said sheet material at an undulation approximately centrally between said first and second side edges;

first and second magnet strips, said first strip mounted on said sheet material adjacent said first side edge, and said second strip mounted on said sheet material adjacent said second edge; and said sheet material attached to said housing by said magnet strips with said undulation extending toward said light source, so that said solar cell is disposed in close proximity to said light source.

16. An assembly as recited in claim 15 wherein said sheet material is cardboard, and said undulating configuration is an accordion configuration, and said means for mounting said solar cell to said sheet material comprises a UV inhibited transparent plastic film.

* * * * *